United States Patent [19]

Sudweeks

[11] Patent Number: 4,758,289

[45] Date of Patent: Jul. 19, 1988

[54] BLASTING AGENT IN MICROCAPSULE FORM

[75] Inventor: Walter B. Sudweeks, Orem, Utah

[73] Assignee: Ireco Incorporated, Salt Lake City, Utah

[21] Appl. No.: 63,981

[22] Filed: Jun. 18, 1987

[51] Int. Cl.[4] ..... C06B 45/34

[52] U.S. Cl. ..... 149/8; 149/109.6; 428/402.2; 428/402.22; 264/3.4; 264/3.5; 264/4.3; 264/4.33

[58] Field of Search ..... 264/3.4, 3.5, 4.3, 4.33; 149/8, 109.6; 428/402.22, 402.2

[56] References Cited

U.S. PATENT DOCUMENTS 3,287,189 11/1966 Wilson et al. ..... 149/8

3,423,489 1/1969 Arens et al. ..... 264/4

3,646,174 2/1972 Macri ..... 264/3.4

4,491,489 1/1985 Ellis et al. ..... 264/3.5

4,525,225 6/1985 Cechanski ..... 149/2

4,632,714 12/1986 Abegg et al. ..... 149/2

*Primary Examiner*—Stephen J. Lechert, Jr.

[57] ABSTRACT

The invention relates to a waterproof, free-running blasting agent and method of manufacturing the same and, more particularly, to a blasting agent in the form of microcapsules (small spherical-shaped particles comprising fluid or hardened droplets surrounded by a hardened shell material). The microcapsules are waterproof and free-running and are generally of a size ranging from about 10 to about 1000 microns or larger in diameter.

13 Claims, No Drawings

BLASTING AGENT IN MICROCAPSULE FORM

Free-running blasting agents are common. Perhaps the most universally used free-running blasting agent is ANFO (porous AN prills containing an oxygen-balancing amount of liquid fuel oil absorbed on and into the prills). Although ANFO is free-running, it is not waterproof and cannot be used in water-containing boreholes unless it is packaged or treated in some fashion to make it waterproof or unless the borehole is lined or dewatered. Various efforts at waterproofing ANFO have been used, such as by coating the prills with a water-resisting agent. A common approach to "waterproofing" ANFO to at least some degree is to combine AN prills or ANFO with sufficient amounts of water-resistant water gels or water-in-oil emulsions to surround the individual prills. The degree of water resistance is dependent upon the ratio of the two ingredients and/or the type of packaging used. This limits considerably the ratios of ingredients that can be used which in turn limits the detonation and performance characteristics. These blasting agents also require the forming and handling of two separate components, and the fluid component is considerably more expensive than the ANFO or prill component.

The only waterproof, free-running commercial blasting agent is a product known as "Pelletol," which is TNT in the form of oval-shaped, smooth pellets. Although waterproof, Pelletol is relatively expensive, and is a molecular high explosive with attendant fume and handling problems.

A need therefore exists for a waterproof, free-running blasting agent which is relatively inexpensive, easy to handle and can be used in packaged or bulk form. The microcapsules of the present invention fulfill this need and overcome the above-described problems of prior art blasting agents. The microcapsules are uniform, waterproof, and free-running and can be formed from relatively inexpensive ingredients and by relatively simple, inexpensive methods.

The microcapsules are formed by first forming a solution (which may be a melt) of inorganic oxidizer salt or salts selected from the group consisting of ammonium, alkali and alkaline earth metal nitrates, chlorates and perchlorates and mixtures thereof. The solution is formed at an elevated temperature above the salt crystallization temperature. This solution then is formed into small droplets that are encapsulated by a fluid organic fuel which is subsequently hardened to form a solidified shell around the solution or melt droplet, which may be solid at ambient temperature or temperatures of use. Alternatively, the solidified shell may be formed by known methods of in situ or interfacial polymerization or precipitation.

The organic fuel is selected from the group consisting of polymers, prepolymers, waxes or wax-like materials and mixtures thereof. The organic fuel must be fluid during formation of the microcapsule, in order to surround the liquid droplet of oxidizer solution. Once the microcapsule is formed, the organic fluid must be capable of being hardened or solidified to form a protective shell around the droplet. An example of such a fuel is a wax which is solid at ambient temperatures but fluid at elevated microencapsulation temperatures. Other means of hardening include chemical reaction and solvent extraction or evaporation. Polymerization or the inclusion of thickening and cross-linking agents in the organic fuel also can be employed. Various organic additives to the fuel phase such as oils and plasticizers also may be included to vary the physical characteristics of the shell material as desired.

The oxidizer salt solution preferably is comprised of from about 10 percent to about 25 percent by weight of the total composition water and from 75 percent to about 90 percent inorganic oxidizer salt, preferably ammonium nitrate alone or in combination with calcium nitrate and/or sodium nitrate. Water-compatible liquids such as ethylene glycol or formamide may be used to replace some or all of the water. An anhydrous or molten solution of oxidizer salts also may be used. This may include eutectic mixtures of oxidizer salts and compatible melting point lowering solids such as urea, sodium acetate, etc. The oxidizer salt solution must be fluid at encapsulation temperatures but thereafter may solidify or crystallize within the microcapsule. The viscosity of the oxidizer solution can be increased by the inclusion of thickening agents such as polysaccharide polymers with or without cross-linking agents.

The bulk density of the microcapsule blasting agent should range from about 0.6 to about 1.2 g/cc. Density control agents such as hollow glass or plastic microspheres may be added as sensitizers to provide hot spots during detonation and may be added to the microcapsules either by addition to the oxidizer droplet phase or the fuel phase or both, or they simply may be added to and physically admixed with the microcapsules.

The concept of microencapsulation is known. It has been used with a wide range of shell materials and filler substances and for a number of reasons. For example, microcapsules of various compositions have been used to protect reactive materials from their environments until time of use, to permit safe and convenient handling of toxic or noxious materials, to provide for controlled release of materials (such as in pharmaceutical products) and to permit liquids to be handled as solids. Certain of these reasons are realized in the present invention, but other reasons, unique to blasting agent microcapsules, also are realized. A blasting agent requires an intimate mixture of oxidizer and fuel components to enhance reactivity and thus detonation sensitivity. This intimacy is achieved in the present invention by surrounding the small oxidizer solution droplets with the fuel shell. In addition, using the fuel as the protective shell, rather than an inert material, allows the entire capsule to react completely upon detonation, thereby producing maximum energy.

As is well known, a blasting agent performs closer to its theoretical maximum energy production if it is oxygen-balanced or nearly so. Preferably, the oxygen balance of the compositions or microcapsules of the present invention should range from about a +5 to about a −20. To achieve an oxygen balance within this range, the organic fuel shell must be relatively thin or too much fuel will be present in the microcapsule and the oxygen balance will be too negative, depending on the type and purity of the fuel used. If a relatively pure form of a hydrocarbon fuel is used, the thickness of the shell preferably should range from about 1 to about 20 microns when used with an oxidizer salt solution having a composition falling within the preferred ranges set forth above. If the shell material contains nonhydrocarbon substances, for example, polysaccharides or proteins, then a thicker shell is possible since the oxygen balance of the fuel material is less negative.

Microencapsulation by physical methods is known. One method is to extrude a fluid rod of filler material (oxidizer salt solution) into a fluid sheath of shell material (organic fuel) to form a fluid cylinder and then to force the fluid cylinder through a nozzle to allow the fluid cylinder to break up and form the encapsulated droplets. Another method is to accomplish encapsulation of the filler material by means of centrifugal extrusion, such as described in the article: John T. Goodwin and George R. Somerville, "Microencapsulation by Physical Methods," *Chemtech*, Vol. 4, October 1974, pp. 623–626. Another method is to surround the nozzle with a carrier fluid which receives the extruded, encapsulated droplets. The carrier fluid is at a temperature slightly above the solidification temperature of the fluid shell material to allow formation of the droplets, then is lowered to cause solidification of the shell material and then is separated from the finished capsules. Microencapsulation also can be accomplished by chemical means known to those skilled in the art. See, for example, U.S. Pat. Nos. 3,429,827; 3,577,515; 3,575,882 and 4,251,387.

An example of microcapsules of the present invention is as follows (all percentages are by weight):

| Filler Material | Shell Material |
|---|---|
| 72% Ammonium nitrate | 45% Paraffin wax |
| 11% Sodium nitrate | 45% Hydrocarbon resin |
| 17% $H_2O$ | 10% Polyethylene |
| 100% | 100% |

Filler 90% Shell 10%
Average size: 600–700 microns
Bulk density (loose): 0.70 g/cc
Bulk density (packed): 0.73 g/cc
Particle density (air picnometer): 1.26 g/cc
Shell thickness: 10 microns Water Resistance (determined by $NO_3^-$ leach rate)

| Time | % available $NO_3^-$ in leach $H_2O$ | % sample weight lost to $H_2O$ |
|---|---|---|
| 1 hr | 2.75 | 1.14 |
| 2 hr | 2.75 | 1.14 |
| 3 hr | 2.89 | 1.20 |
| 4 hr | 3.20 | 1.33 |
| 6 hr | 3.32 | 1.38 |
| 24 hr | 3.78 | 1.57 |
| 2 days | 4.17 | 1.73 |

Detonation Results

Velocity 3000–5000 m/sec
Critical Diameter <4 inches
Booster Sensitive

While the present invention has been described with reference to certain illustrative examples and preferred embodiments, various modifications will be apparent to those skilled in the art and any such modifications are intended to be within the scope of the invention as set forth in the appended claims.

What is claimed is:

1. A method of forming a waterproof, free-running blasting agent in the form of separate, discrete microcapsule particles comprising forming a solution of inorganic oxidizer salt and encapsulating droplets of the solution in a thin coating of an organic fuel.

2. A method according to claim 1 wherein the step of encapsulating the solution droplets comprises extruding a fluid rod of solution into a fluid sheath of organic fuel to form a fluid cylinder and forcing the fluid cylinder through a nozzle to allow the fluid cylinder to break up and form the encapsulated droplets.

3. A method according to claim 1 wherein the step of encapsulating the solution droplets is accomplished by means of centrifugal extrusion.

4. A method according to claim 2 in which a duct of carrier fluid surrounds the nozzle and receives the encapsulated droplets.

5. A method according to claim 4 wherein the temperature of the carrier fluid in the duct is initially slightly above the solidification temperature of the fluid organic fuel to allow formation of the droplets, then the temperature is lowered to cause solidification of the organic fuel coating and then the carrier fluid is separated from the encapsulated droplets.

6. A method according to claim 1, 2, 3 or 4 wherein the solution is above its crystallization temperature and the organic fuel is above its solidification temperature when combined to form the encapsulated droplets which thereafter are allowed to cool to ambient temperature to allow the coating to solidify.

7. A method according to claim 1 wherein the step of encapsulating the solution droplets is accomplished by means of in situ or interfacial polymerization or precipitation.

8. A water-proof, free-running blasting agent in the form of separate, discrete microcapsule particles comprising a solution of inorganic oxidizer salt encapsulated within a coating of organic fuel.

9. A blasting agent according to claim 8 wherein the organic fuel is solid at ambient temperature and is selected from the group consisting of polymers, prepolymers, waxes or wax-like materials and mixtures thereof.

10. A blasting agent according to claim 8 wherein the inorganic oxidizer salt is selected from the group consisting of ammonium, alkali and alkaline earth metal nitrates, chlorates and perchlorates and mixtures thereof.

11. A blasting agent according to claim 8 having an oxygen balance between +5 and −20.

12. A blasting agent according to claim 8 wherein the microcapsules are of a size ranging from about 10 to about 1000 microns.

13. A blasting agent according to claim 12 wherein the organic fuel coating is from about 1 to about 20 microns in thickness.

* * * * *